US006250236B1

(12) United States Patent
Feizollahi

(10) Patent No.: US 6,250,236 B1
(45) Date of Patent: Jun. 26, 2001

(54) MULTI-ZONED WASTE PROCESSING REACTOR SYSTEM WITH BULK PROCESSING UNIT

(75) Inventor: Fred Feizollahi, San Ramon, CA (US)

(73) Assignee: Allied Technology Group, Inc., Fremont, CA (US)

( * ) Notice: Subject to any disclaimer, the term of this patent is extended or adjusted under 35 U.S.C. 154(b) by 0 days.

(21) Appl. No.: 09/436,463

(22) Filed: Nov. 8, 1999

Related U.S. Application Data

(60) Provisional application No. 60/107,726, filed on Nov. 9, 1998.

(51) Int. Cl.[7] ..... F23J 15/00; F23G 7/06; F23G 5/00; F23G 5/10; F23G 7/00

(52) U.S. Cl. ..... 110/346; 110/342; 110/344; 110/345; 110/235; 110/203; 110/210; 110/211; 110/233; 110/250; 110/242

(58) Field of Search ..... 110/341, 342, 110/344, 345, 346, 235, 203, 210, 211, 233, 250, 212, 215, 216, 252, 255, 257, 297, 242, 293

(56) References Cited

U.S. PATENT DOCUMENTS

| | | | |
|---|---|---|---|
| 946,355 | 1/1910 | Harden . | |
| 3,163,134 | 12/1964 | Stratford . | |
| 4,299,611 | 11/1981 | Penberthy | 65/27 |
| 4,438,706 | 3/1984 | Boday et al. | 110/238 |
| 4,508,040 | 4/1985 | Santen et al. | 110/347 |
| 4,509,434 | 4/1985 | Boday et al. | 110/238 |
| 4,602,991 | 7/1986 | Kulkarni | 208/400 |
| 4,644,877 | 2/1987 | Barton et al. | 110/250 |
| 4,729,891 | 3/1988 | Kulkarni | 423/650 |
| 4,770,109 | 9/1988 | Schlienger | 110/247 |
| 4,794,871 | 1/1989 | Schmidt et al. | 110/341 |
| 4,815,397 * | 3/1989 | Minnie, Jr. | 110/223 |
| 4,863,702 | 9/1989 | Galloway et al. | 422/189 |
| 4,874,587 | 10/1989 | Galloway | 422/189 |
| 4,896,614 | 1/1990 | Kulkarni | 110/346 |
| 4,913,069 | 4/1990 | Schultz et al. | 110/346 |
| 4,919,190 | 4/1990 | Newman et al. | 164/250.1 |
| 4,944,236 * | 7/1990 | Sheen | 110/257 |
| 4,949,653 * | 8/1990 | Rast | 110/235 |
| 4,977,837 * | 12/1990 | Roos et al. | 110/165 A |
| 4,980,092 | 12/1990 | Pineau et al. | 252/632 |

(List continued on next page.)

OTHER PUBLICATIONS

ATG Safeglass Process, pp. 5–8.*
ATG Inc. Statement of Qualifications (1998).

*Primary Examiner*—Denise L. Ferensic
*Assistant Examiner*—K. B. Rinehart
(74) *Attorney, Agent, or Firm*—Stoel Rives LLP

(57) ABSTRACT

A preferred waste treatment system and method employs multiple reactor zones for processing heterogeneous waste. In one embodiment, the reactor system (10) includes the following components: first (12) and second (14) solid waste feed subsystems; a liquid waste feed subsystem (16); a plasma torch or gas burner (18) for heating a preliminary vitrification chamber (20) of the reactor system (10); a joule effect heater (22) for heating a vitrification chamber (24); a gaseous effluent processing subsystem (26); first (30) and second (32) slag discharge processing subsystems; and a bulk processing unit (400), including a loading and/or cooling area (406), a waste destruction chamber (408) heated to temperatures between about 250° F. and 2100° F.; a conveying mechanism (418) between the loading area (406) and the waste destruction chamber (408). In an alternative embodiment, each of the reactor zones is heated by joule effect heaters. The reactor system (10) can be operated in an oxidation or reduction mode. In either mode, the reactor system (10) allows for more complete reaction of a variety of heterogeneous waste.

22 Claims, 7 Drawing Sheets

U.S. PATENT DOCUMENTS

| | | | |
|---|---|---|---|
| 4,989,522 | 2/1991 | Cline et al. | 110/250 |
| 5,005,494 | 4/1991 | Schlienger | 110/341 |
| 5,010,829 | 4/1991 | Kulkarni | 110/346 |
| 5,090,340 | 2/1992 | Burgess | 110/346 |
| 5,123,364 | 6/1992 | Gitman et al. | 110/346 |
| 5,136,137 | 8/1992 | Schlienger | 219/121.59 |
| 5,138,959 | 8/1992 | Kulkarni | 110/346 |
| 5,281,790 | 1/1994 | Nguyen Handfield et al. | 219/121.38 |
| 5,288,969 | 2/1994 | Wong et al. | 219/121.52 |
| 5,292,695 | 3/1994 | Galloway | 502/53 |
| 5,301,620 | 4/1994 | Nagel et al. | 110/346 |
| 5,369,947 | 12/1994 | Dummersdolf et al. | 60/39.02 |
| 5,423,271 | 6/1995 | Schulze | 110/237 |
| 5,427,738 | 6/1995 | Galloway | 422/26 |
| 5,434,333 | 7/1995 | Jantzen et al. | 588/3 |
| 5,511,496 | 4/1996 | Schoener et al. | 110/346 |
| 5,541,386 | 7/1996 | Alvi et al. | 219/121.38 |
| 5,555,822 | 9/1996 | Loewen et al. | 110/237 |
| 5,660,123 | 8/1997 | Tadmor et al. | 110/216 |
| 5,666,891 | 9/1997 | Titus et al. | 110/250 |
| 5,678,496 | 10/1997 | Buizza et al. | 110/229 |
| 5,802,993 * | 9/1998 | Meador | 110/345 |
| 5,809,911 | 9/1998 | Feizollahi | 110/346 |
| 6,127,645 * | 10/2000 | Titus et al. | 219/121.36 |

* cited by examiner

MULTI-ZONED WASTE PROCESSING REACTOR SYSTEM WITH BULK PROCESSING UNIT

This application claims benefit to U.S. provisional application Ser. No. 60/107,726, filed Nov. 9,1998.

FIELD OF THE INVENTION

The present invention relates generally to multi-zone reactor systems for processing waste and, in particular, to a multi-zone reactor system for destruction, vitrification and recycling of bulk solid, liquid, and/or mixed-phase waste.

BACKGROUND OF THE INVENTION

Processing of waste and especially hazardous waste, is a continuing problem for many industries and in non-industrial settings. Landfill space is decreasing and costs are rising. Moreover, the shipment and processing of hazardous waste can pose a significant risk to public health and the environment. In view of these concerns, the public and industry have long sought waste processing solutions that reduce waste volume, detoxify hazardous content and/or neutralize or stabilize waste products to prevent undesired spreading through leaching, airborne discharge or the like.

A particularly challenging problem is the treatment and disposal of heterogeneous waste, i.e., waste materials that are highly variable in their chemical composition and physical properties. Such waste may include organics, inorganics and mineral compounds and may be in the form of solids, liquids or mixed phase materials. Heterogeneous waste is produced in many environments including households, semiconductor fabrication facilities, chemical and petrochemical industrial plants, hospitals, military bases, chemical and nuclear weapon production facilities, and fossil fuel and nuclear power plants.

Conventional waste processing reactor systems generally lack the versatility needed to effectively handle a broad range of heterogeneous waste. Such systems typically process waste in a reactor chamber that is heated by a plasma torch, or an induction or joule effect heater. Unfortunately, each of these reactor types has disadvantages for processing certain types of waste. For example, induction heaters are problematic for certain types of waste. In particular, induction heaters are suitable mostly for melting metal and their efficiency and effectiveness are greatly reduced when the waste contains other materials such as cellulose and plastic. Plasma heaters, on the other hand, do not have space requirements suited for complete reaction and polishing of effluent gases over the reactor bed in many applications. Single zone joule effect reactors are, however, problematic for processing waste streams that may contain metallic materials. Joule effect heaters employ a pair of electrodes that extend into the reactor bed to electrically heat the reactor bed as well as the waste contained in the reactor bed. Any molten metallic materials in the waste can provide a conductance path between the electrodes and short-circuit the electrical resistance that generates the joule effect heat.

Thus, most feed preparation operations require sorting and contact handling by the operators to reduce the size of objects and remove objects that are not suitable for processing by the particular heater type or configuration of the reactor system. For example, where joule effect heating is employed, the feed waste materials must be sorted to remove metallic elements, a rather time consuming and costly process. Handling of waste objects, especially in the case of biomedical, infectious, or radioactive waste, can also jeopardize the health and safety of the operator.

Another disadvantage of current reactor systems are their inability to prevent various waste batches from mixing (or co-mingling) with one another. In a typical operation, the inert components of the various waste feed batches mix with one another, accumulate in the bottom of the chamber and melt as a single homogeneous glass matrix.

Accordingly, an improved waste reactor system is, therefore, desirable.

SUMMARY OF THE INVENTION

An object of the present invention is, therefore, to provide an improved waste reactor system.

Another object of the invention is to provide such a waste reactor system and method for handling waste that employ a bulk processing chamber, adapted for in-container thermal destruction, in addition to its other processing chambers.

The present invention is directed to multi-zone reactor systems, related subsystems, and associated methods of the types described in U.S. Pat. No. 5,809,911 of Feizollahi for improved processing of heterogeneous waste. Such reactor systems are useful for processing solid, liquid, and mixed phase waste generated in a variety of environments and having correspondingly varied compositions which may include metallic materials, cellulose and plastic material, and hazardous organic components. These reactor systems have been employed to reduce waste volume, destroy hazardous organic components, stabilize toxic metals and compounds into an increasingly non-leachable solid, recover reusable products and energy, and release stable compounds to the surrounding environment.

The multi-chamber reactor of Feizollahi can be operated in oxidation or reduction modes and includes at least first and second chambers containing respective first and second reactor beds heated to temperatures of at least 2,000° F. and, more preferably to temperatures of about 2,500° F. The first and second reactor beds are heated by heaters of the same or different types. In one embodiment, the first and second reactor beds are both heated by joule effect heaters and is best suited for waste feedstocks that contain little or no metallic materials. Waste is introduced into the first chamber where it is reacted to yield a first waste by product in the first reactor bed and a first effluent outside of the first reactor bed. In the second chamber, the first effluent is reacted to yield a second reaction product in the second reactor bed and a second effluent outside of the second reactor bed. The second reactor chamber provides additional space and retention time for processing a gaseous effluent from the first reactor and allows for settlement of particulates into the second reactor bed for further reaction.

The present invention includes an additional bulk processing unit (BPU), adapted for in-container thermal destruction, that facilitates processing of large bulk material in relatively large packaging or shipping containers and reduces the safety and health risks to operators sorting or handling the waste feedstock. While still in the containers, the organic material including the hazardous contents of the waste feedstock is thermally destroyed and converted to gaseous and solid decomposition products. The gaseous decomposition products are conveyed to a vitrification reactor for conversion into safe products including $CO_2$ and $H_2O$. The solid decomposition products such as ash and inert material that can be fed to the other reactor chambers for vitrification.

The waste feedstock containers can be safely removed from the BPU, and the contents of the containers can be subjected to metal or other sorting processes, transferred to a subsequent reactor chamber, or deposited in a storage area for later processing. The metal sorting can include screening through a sieve and/or a magnetic is separator. In the subsequent reactor chamber, the ash and inert residues are melted to form a highly leach resistant final glass product.

To avoid mixing waste batches that must not be co-mingled, the ash and inert residues generated from waste feedstocks of similar constituents, properties, or origin, are accumulated in respective storage containers. When a sufficient quantity of a particular waste residue is accumulated, the reactor chambers are drained to remove all previous molten glass, so the different types of accumulated residues can be processed separately.

The invention, therefore, facilitates removal of a maximum amount of organic material from the waste so that it is safer for the operators to handle; facilitates differentiation and maintenance of separate waste feeds to the reactor chambers whenever the waste feeds are unsafe to mix or whenever separate processing of the waste is desired for better tracking of certain waste types; eases size reduction requirements for the waste feedstock; increases the efficiency of sorting and removal of metals from the waste feedstock; allows efficient processing of large volumes of liquid waste having high total dissolved solids; and improves the efficiency of volume and mass reduction.

The present invention also facilitates waste processing under controlled conditions of time, temperature, and atmosphere to achieve more desirable waste residue characteristics and improve the quality of glass from the reactor beds and improve the quality of the emissions from the reactor system.

Additional objectives and advantages of the present invention will be apparent from the following detailed description of preferred embodiments thereof, which proceeds with reference to the accompanying drawings.

DETAILED DESCRIPTION OF THE INVENTION

In the following description, the present invention is set forth in the context of various alternative embodiments and implementations involving a multi-zone or multi-chamber reactor system for processing heterogeneous waste. It will be appreciated that these embodiments and implementations are illustrative and various aspects of the invention have applicability beyond the specifically described contexts.

Figure 1A:
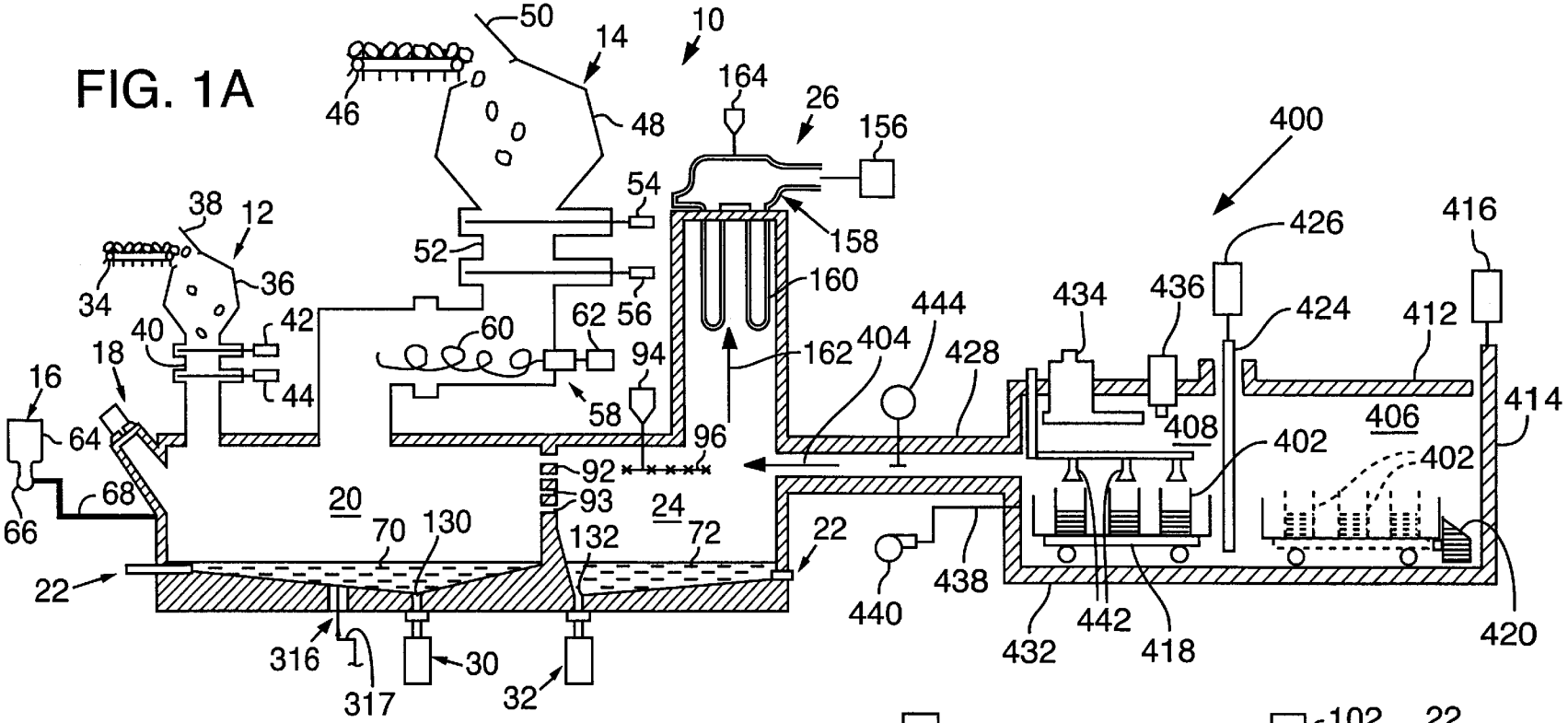
FIG. 1A is a partly schematic diagram illustrating a multi-zone reactor system employing a bulk processing unit in accordance with the present invention.
Figure 1B:
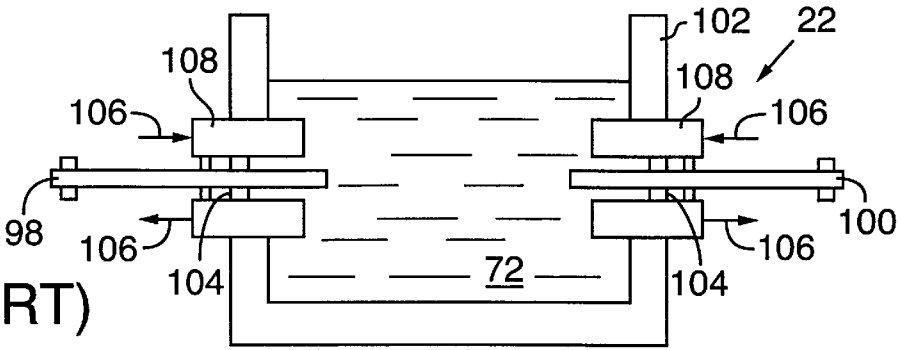
FIG. 1B (PRIOR ART)
FIG. 1B is a cutaway drawing showing details of the side-mounted joule effect heating electrode assembly of the reactor system of FIG. 1A.
Figure 1C:
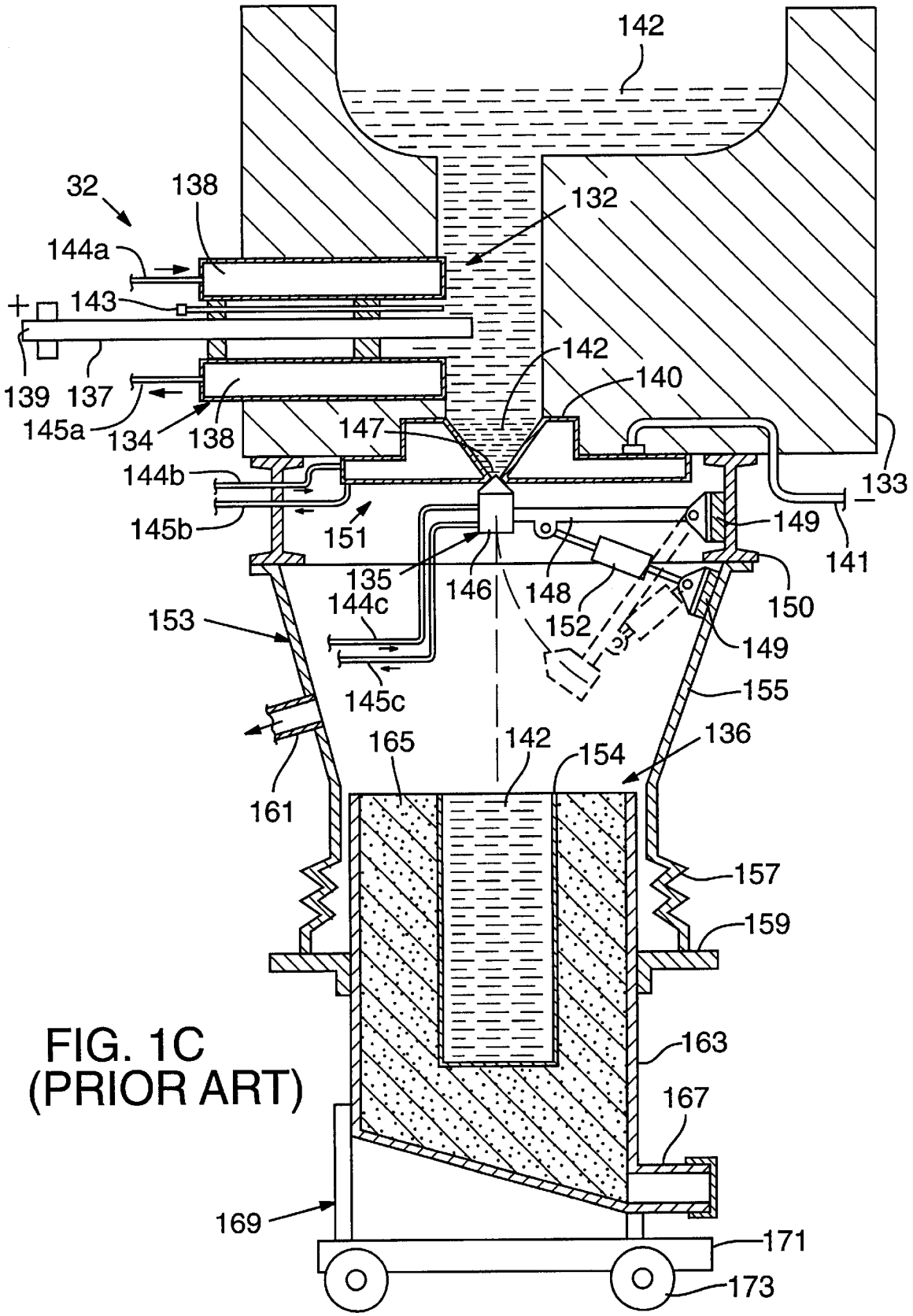
FIG. 1C (PRIOR ART)
FIG. 1C is a cutaway drawing showing details of glass tap and container fill (slag processing) subsystem of the reactor system of FIG. 1A.

Referring to FIGS. 1A–1C (collectively FIG. 1), a multi-zone reactor system 10, constructed in accordance with the present invention, is shown. More particularly, FIG. 1A shows an overview of reactor system 10 and FIGS. 1B–1C show details of various portions of system 10. Generally, system 10 includes the following components:

- first and second solid waste feed subsystems 12 and 14; a liquid waste feed subsystem 16;
- a gas burner 18 or plasma torch assembly and a joule effect heater 22 for heating a first chamber (preliminary vitrification chamber) 20 of the reactor system 10; a joule effect heater assembly 22 for heating a second chamber (vitrification chamber) 24; a gaseous effluent processing subsystem 26; first 30 and second 32 slag discharge processing subsystems; and a bulk processing unit and its components.

First and second solid waste feed subsystems 12 and 14 allow for delivery of a variety of types of generally solid waste into first chamber 20 of reactor system 10. By way of example, the solid waste can include compressible, bagged household waste and/or relatively incompressible industrial waste products, e.g., metallic waste. A variety of solid waste delivery subsystems can be employed in accordance with the present invention. In the illustrated embodiment, first subsystem 12 is a ram feeder for handling generally incompressible solid waste and second subsystem 14 is a screw feeder for handling compressible solid waste.

As shown, first subsystem 12 includes a conveyor 34 for delivering solid waste to an intake hopper 36 via a door 38. Door 38, which reduces backflow of potentially hazardous gases to the surrounding environment, is preferably an automatic door that opens only upon sensing the approach of waste. From intake hopper 36, the waste passes into a lock hopper 40 that is bounded at its ends by hydraulic actuated gate valves 42 and 44. The lock hopper 40 is effective in a reduction mode of operation to reduce the admission of air into the process chambers 20 and 24, as well as to further isolate the surrounding environment from process gases. To introduce waste from intake hopper 36 into the lock hopper 40, upper valve 42 is opened while lower valve 44 remains closed, after a sufficient quantity of waste is received, valve 42 is closed and lock hopper 40 is purged using a low oxygen or oxygen free gas, e.g., an inert gas such as nitrogen. Once the hopper 40 has been purged, lower valve 44 is opened to allow the waste to pass into first chamber 20 of reactor system.

Second solid waste feed subsystem 14 has similar components including a conveyor 46, an intake hopper 48 with an automatic door 50, and a purging lock hopper 52 with upper 54 and lower 56 hydraulic actuated gate valves. In addition, second subsystem 14 of the illustrated embodiment includes a screw feeder 58. The feeder 58 includes an auger like screw element 60 driven by a motor 62. Screw element 60 shreds the waste as the waste is driven towards first chamber 20 of reactor system 10 so as to increase subsequent reaction rates, allow for more complete reaction of the waste and reduce the required residence time of the waste in reactor system 10.

Liquid waste is received into reactor system 10 by liquid or slurry waste feed subsystem 16. Subsystem 16 includes a liquid waste receptacle 64 and a feed pump 66 for pumping liquid waste from receptacle 64 into first chamber 20 of reactor system 10 via intake line 68. Skilled persons will appreciate that first chamber 20 can receive heterogeneous waste in various forms including liquid or slurry waste as well as compressible and relatively incompressible solid waste. Skilled persons will also appreciate that an additional first chamber 20 having the other of gas burner 18 or a plasma torch may also provide even greater versatility in processing waste feedstock.

Reactor chambers 20 and 24 are preferably refractory lined to withhold and withstand extremely high temperatures and include first and second reactor beds 70 and 72, respectively. Beds 70 and 72 are preferably formed from liquid glass and can be maintained in a highly turbulent state by injecting fluid, preferably gases such as air, nitrogen, or oxygen, into the beds, thereby increasing reaction rates.

Reactor system 10 preferably employs a gas burner 18 and a joule effect heater 22 to heat first chamber 20. Skilled persons will appreciate that gas burner 18, with or without joule effect heater 22, may be replaced by a plasma torch where the waste may include metal because a plasma torch is substantially unaffected by metallic waste. Gas burners and plasma torches are well known to skilled persons.

Gas burner 18 and joule effect heater 22 preferably heat first chamber 20 to at least about 2000° F.–2500° F. Prior to activating gas burner 18, first chamber 20 can be preheated to a temperature of about 2000° F. using a conventional natural gas or propane heating device (not shown). The gas employed by gas burner 18 can be varied depending, for example, on the desired chemistry of the reaction process. For example, for operation in an oxidation mode, air, oxygen, or a predetermined mixture of combustion gases may be used so as to provide an oxygen source for the reaction. For operation in a reduction mode, an inert gas such as argon or nitrogen may be employed.

First and second chambers 20 and 24 are separated by a shadow wall 92 (FIG. 1A) that has openings 93 that allow gases to pass from first chamber 20 into second chamber 24. In second chamber 24, additional fluid reactants can be introduced by way of a blower 94 that is piped to a set of mixing nozzles 96. Different reactants may be selected based on the desired chemistry of the reaction. In the oxidation mode, air may be blown into second chamber 24. For operation in the reduction mode, water or water vapor is preferred.

Second chamber 24 is preferably heated by a joule effect heater assembly 22. It should be noted that only one of the electrodes of joule effect heater assemblies 22 is shown in each chamber 20 and 24 in FIG. 1A. FIG. 1B shows more complete details of assemblies 22, which are only described with respect to bed 72 for convenience. Assembly 22 include a positive electrode 98 and a negative electrode 100, each passing through sidewall 102 and terminating within molten bed 72. Bed 72 is heated as a result of current passing through bed 72 between electrodes 98 and 100. A seal is formed between the sidewall 102 and each of electrodes 98 and 100 by a frozen glass plug 104. Plugs 104 are maintained in a frozen state by circulating cooling water, as generally indicated by arrows 106, through mounting sleeves 108.

The reactions that occur in chambers 20 and 24 will vary depending on the nature of the waste and whether the oxidation or reduction mode is selected. The intense heat as from gas burner 18 will generally melt any high boiling point minerals and metals while gasifying any low boiling point metals and minerals and disintegrating any organic compounds. The resulting molten material will reside in first bed 70 and the resulting gases will pass to second chamber 24. In the oxidation mode, the reaction of any carbonaceous gases in the joule heated chamber will be a combustion process whereby oxygen in the air reacts with carbon gases to produce stable gases of carbon dioxide and water. Reaction of any mineral and metal gases will involve oxidation whereupon the elements form oxides. Due to the oxidative environment, most halogens such as chlorine will be present in their elemental form such as chlorine gas ($Cl_2$). Sulfur will form $SO_2$ and nitrogen will form various nitrogen oxide compounds ($NO_x$). Low boiling point metals such as mercury, lead, cadmium, chromium, and nickel will convert to their elemental or oxide forms, vaporize and exit the plasma zone. Some metal oxides, due to a higher boiling point than their elemental form, will condense in the joule effect zone and become part of glass bed 72. The stable gases of carbon dioxide and water along with the volatile metal and mineral gases will flow out of second chamber 24 into gaseous effluent processing subassembly 26.

In the reduction mode, as in the oxidation mode, the intense heat in chamber 20 melts high boiling point minerals and/or metals, gasifies lower boiling point minerals and metals, and disintegrates organic compounds. In the latter regard, carbonaceous materials are gasified to their elemental form such as carbon, hydrogen and other elements. If the reactant injected into second chamber 24 is water, the carbon will react with the water to form hydrogen and carbon dioxide. Due to the reducing environment, most halogens such as chlorine will be present in a hydrated form such as hydrochloric acid, HCl. Sulfur will form $H_2S$ and nitrogen will form $NH_3$. Low boiling point metals such as mercury, lead, cadmium, chromium, and nickel will convert to their reduced form, vaporize and exit the first chamber 20. The water in second chamber 24 can be provided as steam at a temperature of 350° F. or higher produced by a boiler or steam superheater to facilitate the endothermic reaction of carbon with oxygen. Upon complete reaction with water in the second chamber, the resulting gas product is a synthesis gas which is a mixture of CO, $CO_2$, $H_2$, $CH_4$ and trace amounts of other organic gases. Additional particulate products (fine solids) will reside in the second bed due to condensation and particle settling.

In both the oxidation and reduction modes, chambers 20 and 24 will yield separate molten products. These products are removed by first and second slag discharge processing subsystems 30 and 32. First and second discharge processing subsystems 30 and 32 can be of substantially identical construction. However, it will be noted that discharge port 130 (FIG. 1A) of the first subsystem 30 is located at a higher location within bed 70 due to the metal/slag separation, whereas discharge port 132 of second subsystem 32 is located at the bottom of bed 72 in the lowest portion of refractory lined floor 133 of chamber 24, reflecting the lack of metal in second chamber 24. Details of the second subsystem 32 are shown in FIG. 1C, it being appreciated that the details of the first subsystem 30 can be the same in all important respects.

Generally, the subsystem 32 includes a discharge cavity heating assembly 134, a thimble valve assembly 135, and a container filling assembly 136. Heating assembly 134 includes a solid electrode bar 137 supported by a water-cooled electrode holder 138, all of which are fitted through a portion of refractory lined floor 133 such that they slightly penetrate into discharge port 132. Electrode bar 137 is preferably made from a high temperature metal such as molybdenum and receives high voltage electric energy from an electrically conductive wire 139. Heating assembly 134 also includes a hollow, tubular drain ring 140, having a hollow flange, that is adapted to form the bottom of discharge port 132. A high voltage electric power conductor 141 is connected to drain ring 140 and cooperates with wire 139 to provide high electric current flow to glass 142 within discharge port 132. Due to its poor conductivity, glass 142 offers high resistance and converts the electrical energy to heat, becoming molten or semi-molten. The voltage to electrode bar 137 can be increased to bring glass 142 to a fully molten phase to facilitate discharge from discharge port 132 or decreased to return glass 142 to a semi-molten state. The phase of glass 142 is monitored by a thermocouple 143 that is also supported by electrode holder 138. The hollow spaces within electrode bar 137 and drain ring 140 are supplied with circulated cooling water through inlet lines 144*a* and 144*b*, respectively, and outlet lines 145*a* and 145*b*, respectively.

Thimble valve assembly 135 includes a hollow cylindrical thimble plug 146 with a conical end 147 and is connected to an actuator rod 148 that is hingibly connected through an electrical insulator 149 to a structural member 150 of process chamber 151. The hollow space in plug 146 is water cooled via flexible hoses with inlets 144*c* and outlets 145*c*. An actuator 152, connected between actuator rod 148 and a discharge shroud 153, can be pneumatically, hydraulically, or electrically activated to move actuator rod 148 and swing thimble plug 146 away from drain ring 140 to allow molten glass to pour into inner container 154 of filling assembly 136.

Discharge shroud 153 employs a guard pipe wall 155 that is connected between structural member 150 and a flexible boot 157 having a loading flange 159 to contain splashes of molten glass 142. A vent 161 in guard pipe wall 155 is connecter to a filtered air exhaust system. Loading flange 159 is adapted to form an airtight seal about the outside of an outer container 163 for holding a ceramic cooling media 165 that supports inner container 154. Ceramic cooling media 165 functions as a heat sink to prevent thermal damage to inner container 154 from the heat of molten glass 142. A discharge pipe 167 on the outside of outer container 163 permits the level of ceramic cooling media 165 to be adjusted or emptied.

Outer container 163 is placed on platform structure 169 of a dolly 171 with wheels 173. Dolly 171 can be positioned underneath discharge shroud 153, the flexible boot 157 of which can be lowered and raised to respectively engage or disengage loading flange from outer container 163. When inner container 154 is full, dolly 171 is moved to a cooling area, and when glass 142 is cooled, inner container 154 can be removed from the outer container 163.

With reference again to FIG. 1A, gaseous effluent processing subsystem 26 receives gases from the second chamber 24 and, depending on the chemistry and objectives of the overall reaction process, processes the gases to reduce hazardous content and/or to recover energy or a clean fuel by-product for enhanced system efficiency. A number of alternative embodiments of the subsystem 26 are described in greater detail below. FIG. 1A shows an initial component of the subsystem, namely, a high temperature filter 158. Additional components are indicated as box 156 for purposes of illustration. The illustrated high temperature filter 158 includes a ceramic candle filter element 160 located in a cupola above the second chamber 24. The filter 158 receives effluent gases at a temperature of about 1800° F. The gases can be cooled slightly by injecting steam or gas into the effluent stream 162 through a nozzle. The candle filter element 160 removes particulates having a size greater than about 0.3 micron. A gas supply 164 is used to backflush the candle filter element 160 using, for example, air, steam or nitrogen. The backflushed particulates will settle into the bed 72. The exhaust from the high temperature filter 158 passes to additional components, as will be described below, for further processing.

Figure 2:
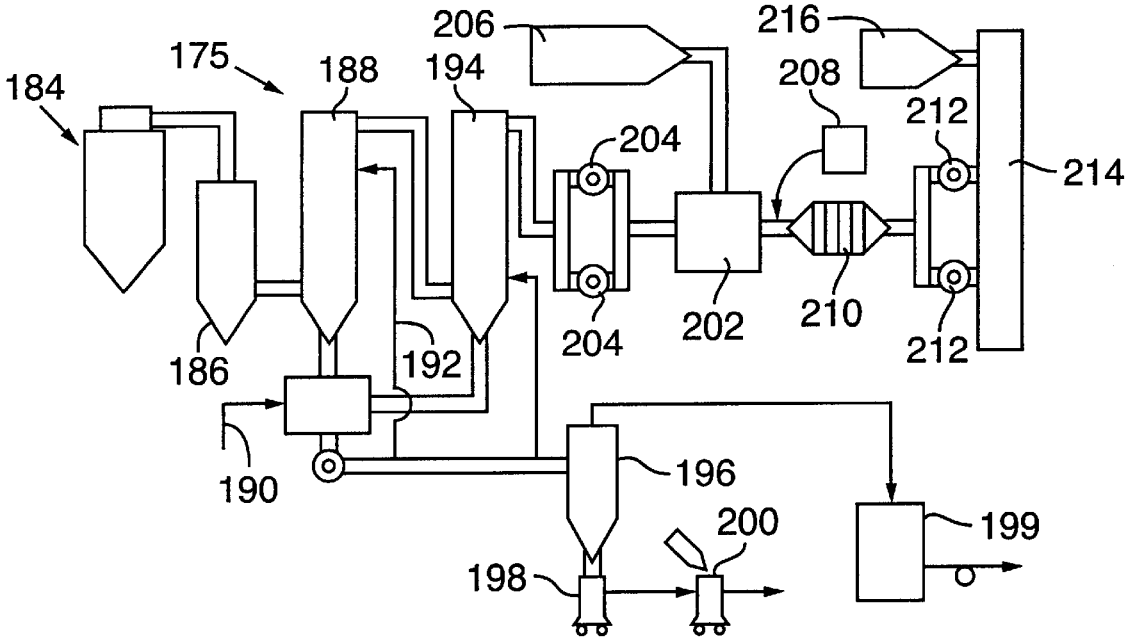
FIG. 2 (PRIOR ART)
FIG. 2 is a schematic diagram showing an embodiment of a gaseous effluent processing system.

FIG. 2 presents a schematic diagram of an alternative embodiment of a gaseous effluent processing subsystem 175. System 175 can replace some or all of the components of subsystem 26 shown in FIG. 1A. System 175 includes various components for filtering and scrubbing the gaseous effluent and is applicable for operation in an oxidation mode or in a reduction mode to yield convertible synthesis gas (syngas) products. However, certain conversion components as set forth below are particularly applicable for reduction mode operation and are described with respect to this mode for convenience.

As previously noted, exhaust from high temperature filter 184 in reduction mode operation is a mixture of CO, $CO_2$, $H_2$, $CH_4$ and trace amounts of other organic gases having a temperature of about 1800° F. This gas has a recoverable energy equal to approximately 300 to 400 btu per cubic foot. Such energy can be recovered by burning the gas in a boiler or using the gas as a fuel in a combustion engine, a turbine or a hydrogen fuel cell. However, before the gas can be recovered, its impurities such as acidic gases and low boiling point metal vapors should be removed to a great extent.

In this regard, the exhaust from the high temperature filter 184 is first sent to a rapid quench tower 186 which reduces the gas temperature from approximately 1800° F. to less than about 250° F. in less than one second. The quench tower 186 is equipped with a number of water spray nozzles that spray concurrently with the effluent gas flow thereby dissipating heat from the syngas. Exhaust from the quench tower 186 is preferably received by a dual vessel scrubber including an alkaline scrubber unit 188 and an acid scrubber unit 194. The scrubber units 188 and 194 can be constructed from any of various materials such as steel, plastic or fiberglass. In the illustrated embodiment, the alkaline scrubber unit 188 comprises a vessel where the syngas enters through an inlet port located in a lower portion of the vessel and exits the vessel through a port located in a upper section of the vessel. In the middle of the vessel, there are separate support plates which house packing material. A scrubbing liquid, which is water mixed with reagents, is sprayed into the syngas stream in the vessel. Some of the liquid sprayed into the syngas stream is collected in a tank 190 disposed beneath the unit 188. A recirculation pump continually recirculates liquids from this tank together with supplemental reagents to the scrubber unit 188 as generally indicated by arrow 192. Preferably, the pH of the scrub solution is feedback regulated. That is, when the pH of the scrub solution deviates from the setpoint, a reagent pump introduces additional reagents into the recirculation tank 190. The reagent may comprise for example NaOH or CaOH which is effective to convert halogen gases to a salt such as NaCl or CaCl. Sulfur is removed as $H_2S$. Upon exiting the alkaline scrub unit 188, the syngas is delivered to an acid scrub unit 194. The acid scrub unit 194 is similar in construction to the alkaline scrub unit 188 but operates at a pH of approximately 6.9 (using NaOH as a reagent) whereas the alkaline unit 188 operates at a pH of approximately 11. The acid scrub unit 194 removes HCl, HI, and $SO_2$. The recirculation tank 190 has an outlet for recovered scrubber liquid or so-called "blow down." The blow down is sent to an evaporator 196 for concentrating the blow down. The concentrates from the evaporator 196 is collected in a tank unit 198 and then stabilized with a reagent in a mixing tank 200 for reuse. The distillate from evaporator 196 is collected a tank 199 and is pumped, for example, back to acid scrub unit 194, for use as make-up water.

The syngas discharged from the acid scrub unit 194 is clean and can be used for energy recovery. This gas is driven from the acid scrub unit 194 to plenum unit 202 by redundant fan blowers 204. The plenum unit 202 also communicates with building ventilation system 206.

At this point in the process, any of various syngas converters, generally identified by the referenced numeral 208, may be employed. Various syngas converter options will be described in detail below. Generally, syngas conversion can encompass either energy recovery (e.g., steam generation, gas turbine, combustion engine, or hydrogen fuel cell) or direct conversion to a stable gas by oxidation (e.g., flare, catalytic converter, or regenerative conversion). The exhaust from the syngas converter 208 is received by a filter bank to 210. The filter bank 210 preferably includes a series of filters including, for example, prefilters, high efficiency particulate absolute (HEPA) filter elements, and charcoal filters. The HEPA filter elements are cloth or fiber elements capable of removing about 99.97% of the particulates above 0.3 microns. The charcoal filters include activated carbon filter and impregnated carbon elements for removing mercury and volatile organic gases. From the filter bank 210, the gas is driven by a single or redundant exhaust fans 212 to stack 214. The gases passing through stack 214 are monitored by continuous activity monitors and continuous emission monitors, generally identified by reference numeral 216 to insure that emissions from the stack 214 to the environment are within acceptable limits.

Figure 3A:
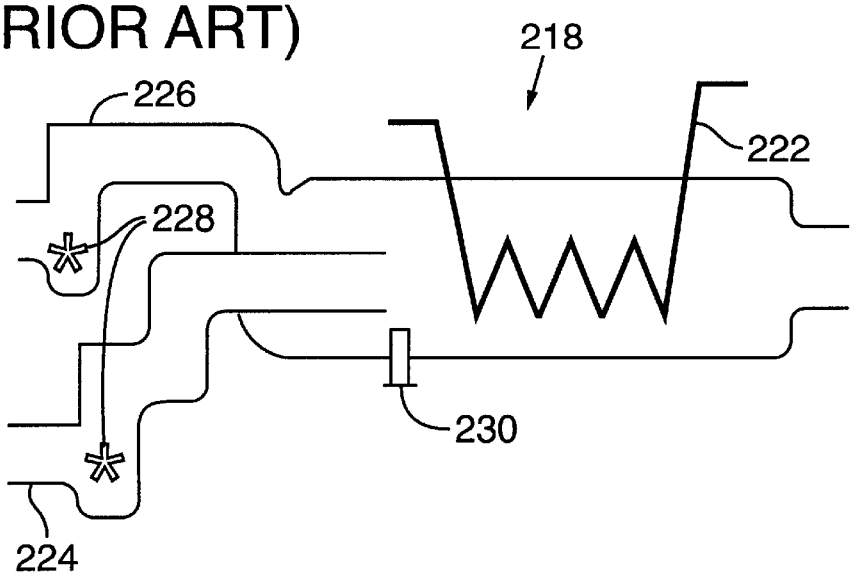
FIG. 3A (PRIOR ART)
FIGS. 3A through 3D show alternative embodiments of a synthesis gas conversion subsystem.

FIGS. 3A through 3D illustrate some of the syngas converter options. Referring first to FIG. 3A, a steam recovery option is illustrated. In this option, the energy of the syngas is utilized to generate steam for use in the reactor system or elsewhere. The illustrated steam recovery subsystem 218 includes a burner chamber 220 and a tube heat exchanger 222. The burner chamber includes a first input receiving syngas from the reactor chambers and a second input 226 for receiving air. The syngas and air are propelled by fans 228. In the burner chamber 220 the syngas and air mix and are ignited by igniter 230. The heat from this combustion heats water passing through the heat exchanger tube 222 to form steam.

Figure 3B:
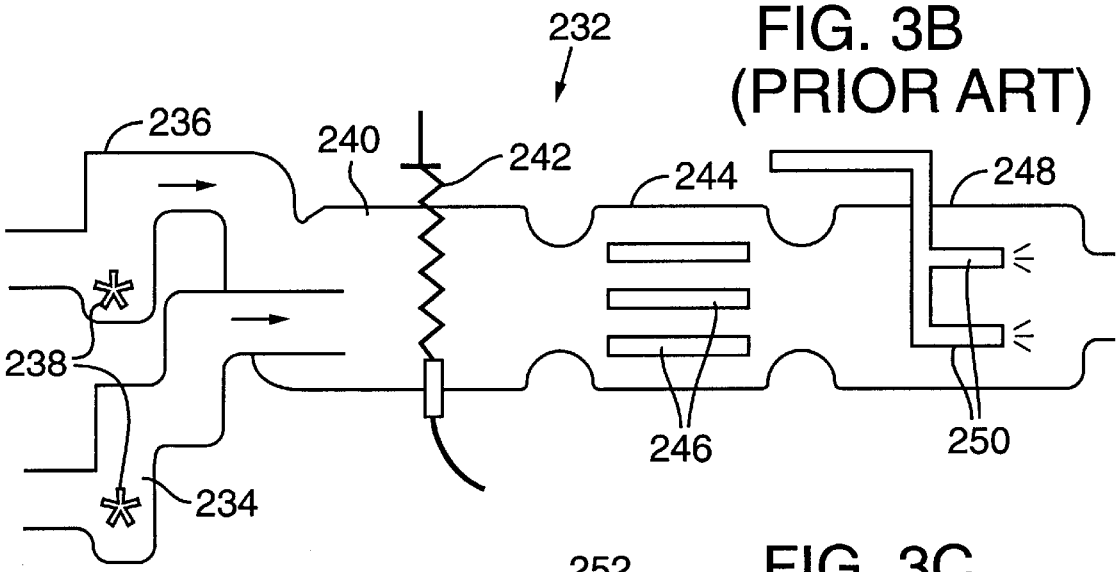
FIG. 3B (PRIOR ART)

FIG. 3B shows a catalytic converter option 232. Similar to the previously described option, the catalytic converter 232 includes a first input 234 for receiving syngas from the reactor chambers and a second input 236 for receiving air. The air and syngas are propelled by fans 238. The syngas and air mix in a gas heating section 240 where the gas is heated to approximately 900° F. by heater element 242. From the heating section 240, the heated gas passes into gas reaction zone 244. In the gas reaction zone 244, the gas passes across catalyst plates 246 coated with platinum and the gases oxidize to a temperature of approximately 1200° F. Finally, the oxidized gases pass into quencher section 248 where the gases are quenched by water delivered through nozzles 250.

Figure 3C:
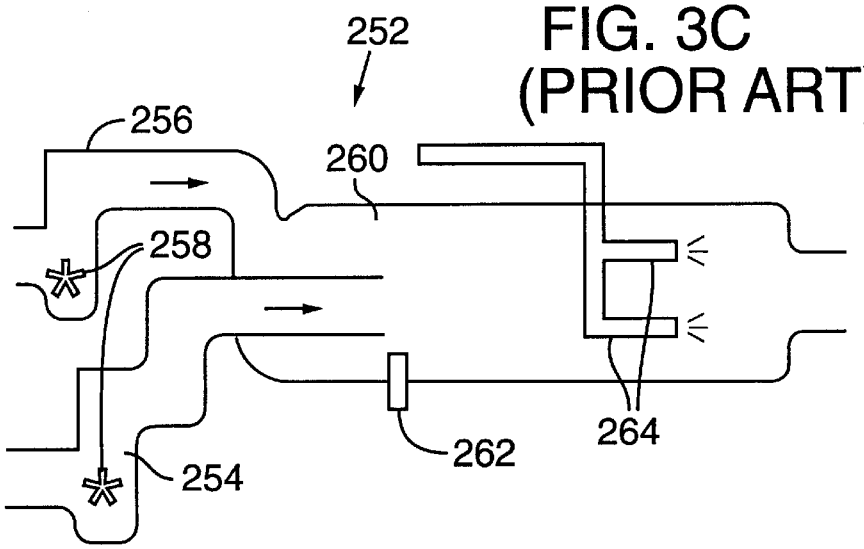
FIG. 3C (PRIOR ART)

FIG. 3C shows a flare conversion option 252. As in the previous options, the flare converter 252 includes a first inlet 254 for receiving syngas from the reactor chambers and a second inlet 256 for receiving air. The air and syngas are driven by fans 258 and mix in flare vessel 260. In the flare vessel 260, the mixture is ignited by igniter 262. The resulting combustion product is then quenched by water delivered through nozzles 264 thereby cooling the combustion product to approximately 150° F.

Figure 3D:
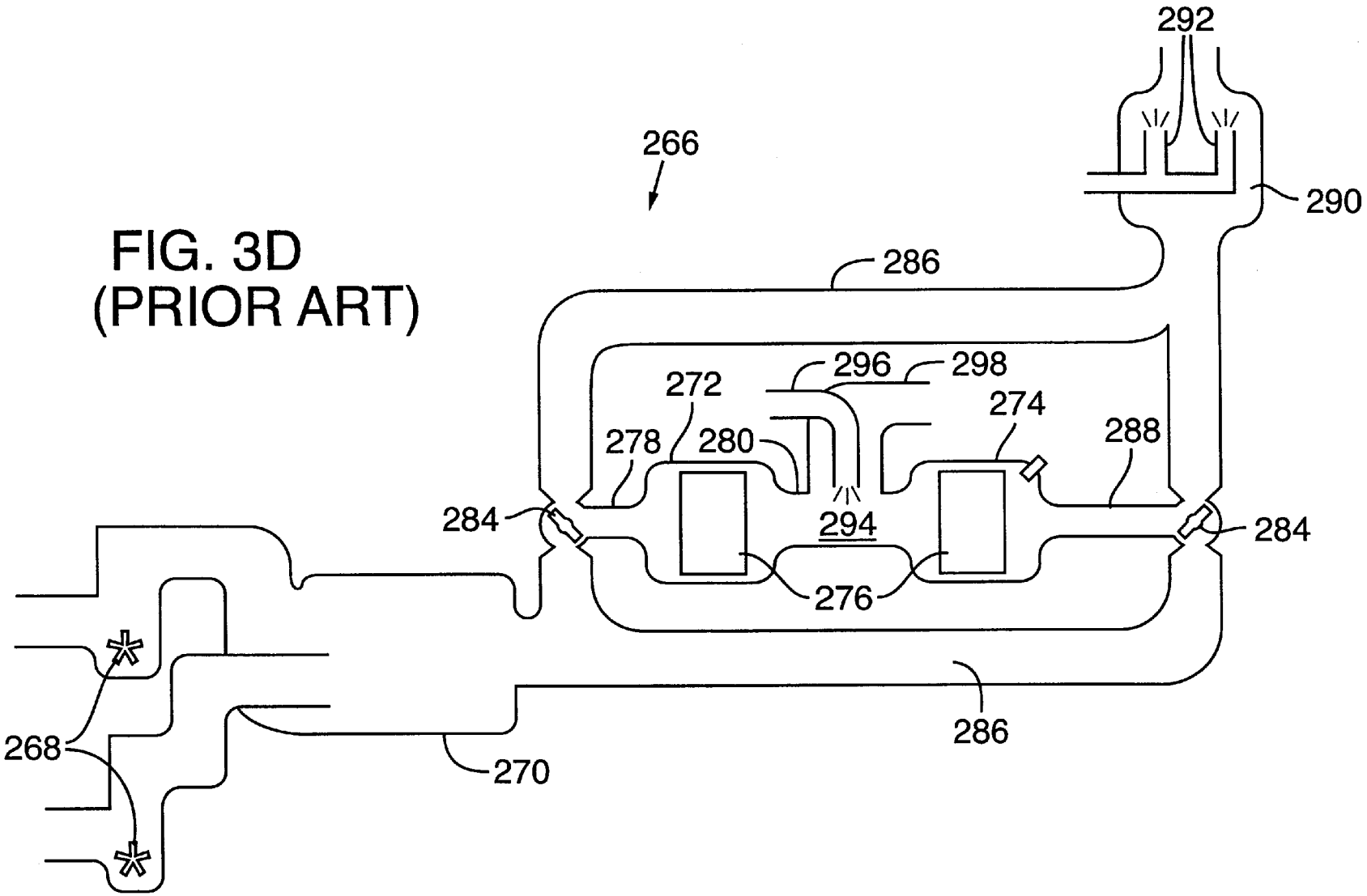
FIG. 3D (PRIOR ART)

FIG. 3D shows a regenerative converter 266. Fans 268 drive syngas and air into a conversion section 270 where the syngas and air mix. The mixture then passes to a conversion device that includes two conversion vessels 272 and 274. Each vessel 272 and 274 has internal support plates 276 that house a silica or alumina based heating medium. The first vessel 272 has a gas inlet port 278 and a gas outlet port 280. The outlet port 280 of the first vessel 272 is connected to an inlet port 282 of the second conversion vessel 274. Each of the two conversion vessels 272 and 274 is associated with a three-way damper 284 and bypass flow ducts 286 that allow reversing the flow either from the second vessel 274 to the first vessel 272 or vice versa. The outlet port 288 of the second conversion vessel 274 is connected to a quench unit 290 where the gas is quenched by water from nozzles 292. In addition, a gas-fired burner 294 is mounted in the pipe that connects the conversion vessels 272 and 274. The burner 294 includes a first inlet 296 for receiving fuel such as propane or natural gas and a second inlet 298 for receiving air.

In operation, the gas-fired burner 294 is turned on to initiate the converter process. Due to the prevailing gas flow from the first conversion vessel 272 to the second conversion vessel 274 the heating medium in the second vessel will heat up to the desired temperature of 1500 to 1800° F. Once this temperature is reached, the syngas and air is allowed to flow in the reverse direction to the unheated first vessel 272. The syngas converts to $H_2O$ and $CO_2$ in the second vessel 274 generating heat from the reaction of $H_2$ and CO with oxygen. The hot gas flows to the first conversion vessel 272 thereby heating the medium in the first vessel 272. A temperature sensor (not shown) senses the heat in the second vessel 274 and, if the temperature drops below the desired level, operates the three-way dampers 284 to reverse the flow of gas such that the flow is from the first vessel 272 to the second vessel 274. It will be appreciated that the dampers 284 can be operated as appropriate whenever the temperature of either vessel drops below the desired temperature of approximately 1500 to 1800° F. If this temperature cannot be maintained, a propane or natural gas valve is automatically turned on to introduce gas into the incoming syngas stream. The additional propane or natural gas will oxidize in the hot bed, thus providing additional heat to raise the bed temperature. This method of conversion promotes complete reaction of the syngas such that the syngas is converted into a stable form—water vapor and $CO_2$. The quencher unit 290 cools the gas discharged from the converter 266 to approximately 150° F.

Figure 4:
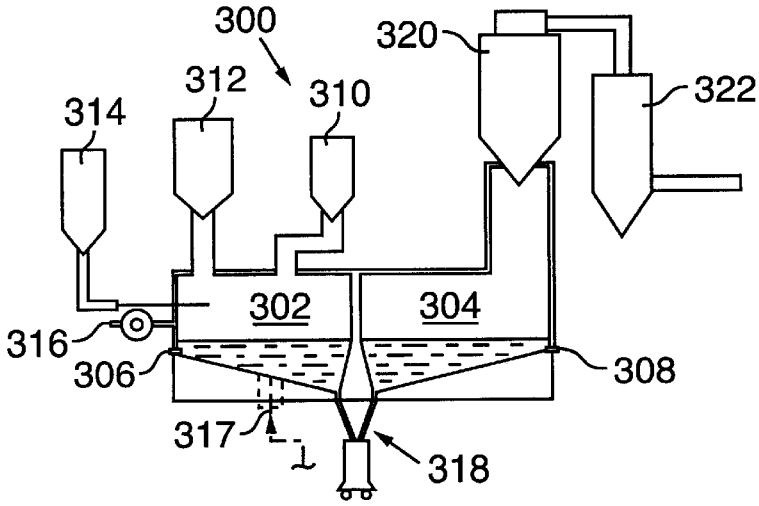
FIG. 4 (PRIOR ART)
FIG. 4 is a schematic diagram showing an alternative embodiment of a multi-zone reactor system.

Referring to FIG. 4, an alternative embodiment of the multi-zone processing chamber is generally identified by reference numeral 300. The illustrated reactor system 300, includes a first chamber 302 and a second chamber 304 that are heated by joule effect heaters 306 and 308, respectively. The illustrated reactor system 300 is particularly applicable for treating waste that is free from, or has been treated to remove, metallic materials. However, the reactor system 300 is suitable for treating a variety of wastes, including compressible solid, relatively incompressible solid, and liquid or slurry waste. In this regard, the system 300 includes first 310 and second 312 solid waste feed subsystems as well as a liquid waste feed subsystem 314 similar to those that have been described previously. The system 300 also includes a reactant injection subsystem 316 for injecting air, oxygen, steam, or another reactant into the first chamber 302 to facilitate more complete reaction of the gaseous effluent. Reactant injection subsystem 316 may be positioned at the bottom of the molten bath or through the side or top of the reactor and may include a water-cooled bubbler tube 317 through which the reactant is injected. It will be appreciated that the discharge from the reactor beds of the first and second chambers 302 and 304 will comprise slag that is substantially free from recyclable metals. Accordingly, a single slag recovery subsystem 318 can be employed to recover slag from each of the chambers 302 and 304. The gaseous effluent from the second chamber 304 can be treated by a high temperature filter 320, a quench tower 322 and additional components (not shown) as described above.

Figure 5:
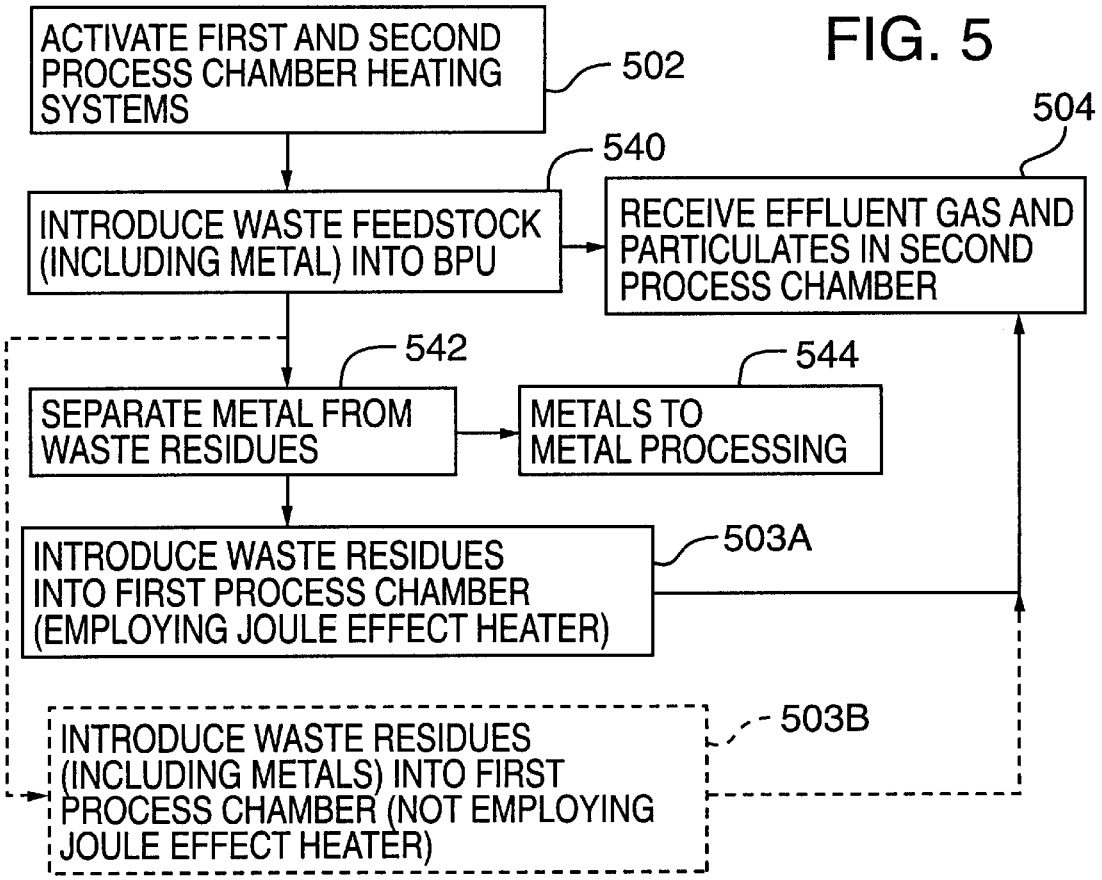
FIG. 5 is a flow chart illustrating a waste treatment process that includes initial processing through the bulk processing unit in accordance with the present invention.
Figure 6:
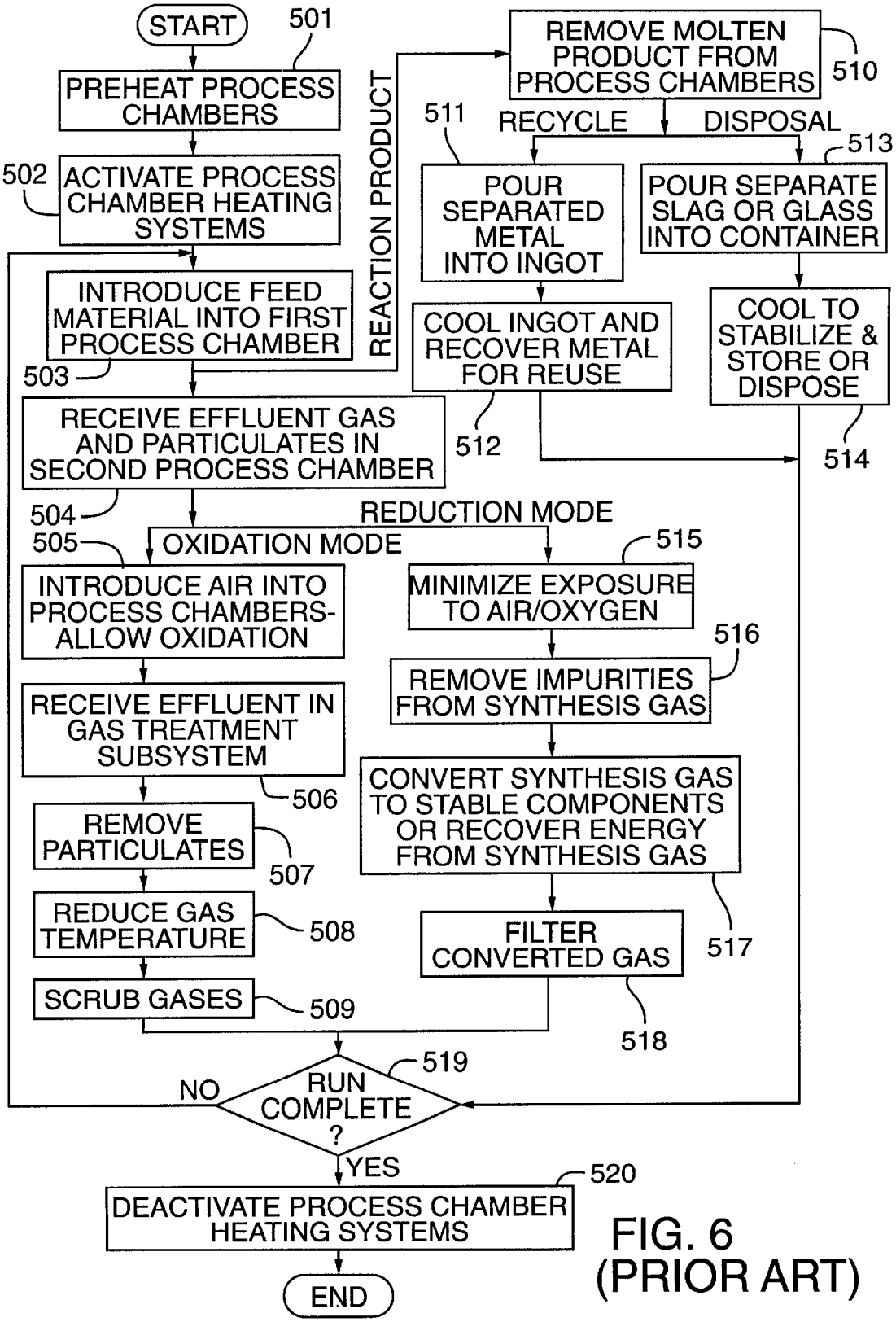
FIG. 6 (PRIOR ART)
FIG. 6 is a flow chart illustrating an overview of a waste treatment process in addition to waste processing in the bulk processing unit.

FIG. 5 is a flow chart illustrating how waste processing in BPU 400 merges into the greater waste processing flow shown in FIG. 6. With reference again to FIG. 1A and FIG. 5, an improvement of the present invention includes a bulk processing unit (BPU) 400 that can be employed to process wastes within containers 402 and vent reaction gases 404 to second chamber 24 of waste reactor system 10. Skilled persons will appreciate that BPU 400 can be incorporated into any of the above-described embodiments of the reactor systems previously described, but BPU 400 is described only with respect to the embodiment shown in FIG. 1A for convenience.

BPU 400 is particularly useful for processing larger (exceeding 8 inches in diameter) biological wastes that may be hazardous (toxic, infectious, or radioactive) for handling, high water volume wastes, and/or heterogenous and/or metal containing wastes that are often loaded into drums. Such wastes can be processed without the sorting, shredding, and blending of typical feed preparation. Thus, little or no direct handling of the waste is necessary. BPU destroys the organic wastes and leaves ash, metal, or other inorganic residues that can be subsequently safely sorted and/or supercompacted or vitrified in the other reactor chambers 20 or 24.

BPU 400 includes a third chamber 406 for loading waste and cooling waste residue and a heavily-insulated fourth chamber 408 for destroying wastes, particularly organic wastes. Chamber 406 is water cooled and has refractory walls 412 and a preferably refractory lined isolation gate 14. Isolation gate 414 covers one side of loading chamber 406 and includes an actuator 416 such as a gear-motor and chain drive that can lower or raise gate 414 from a remote location at the discretion of an operator.

After gate 414 is raised to open loading chamber 404, containers 402 can be loaded (540) onto transport cart 418 or filled with loose waste or waste that may be within smaller containers. Transport cart 418 preferably has a flat structural frame with wheels and is moved by a manipulator 420 to transport waste in containers 402 between chambers 406 and 408. Both transport cart 418 and containers 402 are made from materials that are not affected adversely by temperatures as great as about 1800° F. 2100° F.

Skilled persons will appreciated that chambers 406 and 408 share a horizontal relationship as depicted in FIG. 1A, they could alternatively be connected in a vertical relationship. For example, chamber 406 can be positioned at a higher elevation than 408 and a suitably thermally protected lift mechanism could be used to raise and lower transport cart 418 between chambers 406 and 408. In such an embodiment gate 424 could be horizontal. Skilled persons will also appreciate that a conveyor and refractory airlock system or other similar conveying means could be used in place of transport cart 418 and gate 114.

After waste or containers 402 are loaded onto transport cart 418, the operator pushes a button from a remote location to lower gate 414 to seal loading chamber 406 from workers and the environment. Chamber 406 may be provided with means to introduce reagents or chemical additives to condition the waste feedstock, before or after gate 414 is sealed, to improve the destruction process in BPU 400 or to condition the processed waste residues to make the glassified waste more leach resistant.

After gate 414 is closed, isolation gate 424 between loading chamber 406 and waste destruction chamber 408 is raised or otherwise opened by actuator 426, which also preferably includes a gear motor and chain drive and is controlled by an operator at a remote location. Manipulator 420 then moves transport cart 418 into chamber 408 and returns to chamber 406 without transport cart 418. Actuator 426 subsequently closes gate 424 to seal chamber 408.

Waste destruction chamber 408, which also has insulated, water-cooled, and refractory lined walls 432 is heated, with containers 402 inside, to a desirable temperature. Two heating devices are preferably employed to heat and maintain chamber 408 at temperatures between about 250° F. and 2200° F. depending on the nature of the waste feedstock, and more preferably between 300° F. and 1800° F., or above which the organic waste will be destroyed but most metal waste will not vaporize or become molten. The upper temperature can be adjusted to be below the melting temperature of any type of metal known to be in a particular waste feedstock.

An infrared heater 434 is preferably employed to provide flameless heating to reduce the production of toxic organics and toxic oxides, such as nitrate compounds (NOX compounds), that would otherwise result from incomplete flame-oriented reactions in chamber 408. Infrared heater 434 may comprise one or more, or a combination of, gas, electric, or other heaters within a thermally conveying tube to provide radiant, flameless heat to chamber 408.

Chamber 408 also preferably includes a natural gas or propane burner or heater 436 that is preferably employed to destroy waste feedstocks including liquids or other noncombustible wastes. Both infrared heater 434 and gas burner 436 direct their heat energy toward the top of containers 402 on transport cart 418 and can be variably controlled to control the amount of heat introduced to chamber 408. The amount of heat energy introduced into chamber 408 is partly used to control the time and temperature of the waste destruction process. In addition, one or more of spray nozzles 442 may be directed toward the tops of containers 402 to inject water or other coolants to prevent temperature excursion in chamber 408.

The composition of the atmosphere in chamber 408 can also be varied by introducing various oxidant gases. A blower 440 may be employed to inject air, oxygen, or other desirable gases into chamber 408 through pipe 438 that may include a control valve (not shown). A gas monitoring unit 444 is positioned to measure the quality of the gas discharged from chamber 408 and provides information to an operator or central processing unit that can adjusting the feed rate or the type of oxidant gas injected into chamber 408. In the preferred mode of operation, the injected gas is oxygen, and the oxygen in the effluent is measured by an oxygen monitor and maintained at a desirable level of 4 to 8% excess oxygen.

Chamber 408 may be operated either to discharge a combustible mixture of gases to chamber 24, or to discharge a high-temperature inert flue gas with excess oxygen. An individual processing cycle could include both conditions. Container size, chemical composition, particle size, and density of packing of waste in containers 402 are factors that are used for determining the residence time in chamber 408. This flexibility in controlling time, temperature and atmosphere gives the BPU the ability to process a wide range of waste materials and to control characteristics of the waste residues.

In one example, waste containing liquids and low-vapor pressure salts are processed at lower temperatures (e.g., 250° F. to 1000° F.) so that to minimize volatilization of inert material and maximize retention of such compounds in the bottom of containers 402. Skilled persons will appreciate that these and other liquid wastes may be continually added into containers 402 during the waste destruction operation through liquid waste feed pipes (not shown) at a controlled rate as the volume of waste diminishes within containers 402. The remaining inert and ash residues can subsequently be combined with glass forming additives and transferred into chamber 20 or 24 for final stabilization. In another example, bulk solid material, such as contaminated wood lumber, could be processed at higher temperatures (e.g., 1500° F. to 1800° F.) to ensure that carbon remaining in the residues is low.

Gases 404 generated during the destruction process flow (504) through a refractory lined connecting duct 428 to second chamber 24 where the gases are exposed to temperatures of 1700° F.–2700° F. for a prolonged residence time (of greater than 3 seconds) to allow complete destruction of organic compounds in an oxidative mode or complete conversion to syngas in a reduction mode as previously described. The non-flame electrical heat from glass bed 72 of chamber 24 also keeps NOX compound generation to a minimum. Since gases generated in chamber 408 are preferably routed to chamber 24 instead of directly to an air pollution control system such as gaseous effluent processing subsystem 26, a large portion of particulates generated in chamber 408 is captured and settles on top of bed 72 so few of the particulates generated will reach the air pollution control system. Particulate settling may be so thorough that a solids filter is not employed in the gaseous effluent processing subsystem 26 or 175. Skilled persons will appreciate that when chamber 408 is employed at its highest operating temperatures, its product gases can be directly routed to gaseous effluent processing subsystem 26 or 175. Such an option may be desirable whenever chamber 24 is taken off line for maintenance.

Although duct 428 is shown to be completely horizontal in FIG. 1A, skilled persons will appreciate that it may be advantageous to angle duct 428 up or down between chambers 408 and 24, depending on the nature of the waste feedstock being processed. Duct 428 may be permanently fixed in a single orientation or may be adjustable to one of several alternatively selectable holes in one or both of refractory lined walls 432 and 160.

The destruction of the waste and the end of a thermal destruction cycle in chamber 408 is measured by monitoring the process temperature and the effluent gas concentrations. In a preferred embodiment, the CO concentration is monitored, and the reaction is considered to be complete when the CO concentration drops below 100 parts per million by volume (ppmv). When the end of the processing cycle in chamber 408 is verified, the heaters 434 and 436 are turned off and chamber 408 is allowed to cool to a desired temperature such as 250° F.–500° F. After chamber 408 is sufficiently cooled, gate 424 is opened and cart manipulator 420 transfers cart 418 from chamber 408 to chamber 406, and gate 424 is closed. Skilled persons will appreciate that it is advantageous to maintain chamber 408 at as high temperature as possible to simplify the construction of chamber 408, reduce the amount of thermal stress on the refractory materials, and decrease the amount of cooling and reheating time between batches of waste feedstock.

The conditions in chamber 406 can be controlled to maintain a safe atmosphere and its gases can be discharged into chamber 408 to assure the capture of any volatile waste constituents that night still remain. For example, chamber 406 can be provided with a forced air and/or liquid cooling system that vents to chamber 408. The ventilation or evacuation of chamber 406 may continue for a predetermined period of time or until gas monitors determine that specified air quality and temperature characteristics are reached. These characteristics may be similar to those of ambient temperature, pressure, and gas concentrations or may include temperatures as high as 300° F. Chamber 406 may also include one or more observation ports for access to access and observation of chamber 406.

When the residue and containers have cooled sufficiently, gate 414 is opened and containers 402, or the waste residues from the bottoms of containers 402, are removed. The ash and inert waste residues can then be screened to remove (542) any metals. The residues are then either transferred (503A) directly to chamber 20 or 24 or transferred to an interim storage container, and the metals are processed (544) separately such as by sorting through a sieve and/or a magnetic separator. In one alternative, the residues in the container can be sent to a drum compactor and can be crushed with the residue encapsulated inside the crushed drum. In another alternative, the metals are not separated and the waste residues are sent directly (503B) to an embodiment of chamber 20 that does not employ a joule effect heater.

Care is taken to avoid dispersing ash into the process building during residue handling operations. Use of disposable containers 402, such as fiber drums, minimizes handling of residues. When such combustible containers are used, a tray or similar "secondary" containment is used to collect the waste residues.

Various process options of the present invention can be summarized by reference to the flow chart of FIG. 6. The process according to the present invention can be initiated by preheating (501) the process chamber of a multi-zone reactor using a conventional gas fuel heating system. Once the process chambers are sufficiently preheated, the chamber heating systems, e.g., gas burner, plasma torch or joule effect heaters, are activated (502) and waste feed material is introduced (503) into the first of the process chambers. In the first process chamber the waste is reacted to yield, depending on the nature of the waste, slag, recyclable metals, and a gaseous effluent. The gaseous effluent including particulates is received (504) in the second process chamber. The processing of the effluent will vary depending on whether the reactor system is operated in an oxidation mode or in a reduction mode. In the oxidation mode, air is introduced (505) into the process chambers, for example, by using air as the gas for operating gas burner 18 or the plasma torch or by venting it to one or both of the chambers. Upon exiting the second chamber, the effluent is received (506) in a gas treatment subsystem that removes (507) particulates, reduces (508) the gas temperature and scrubs (509) the gas, among other things. In the reduction mode, exposure to air or oxygen is minimized (515), for example, by employing air locks on the process chambers and using an inert gas such as nitrogen as the operating gas for the plasma torch. Upon exiting the processing chambers, impurities are removed (516) from the synthesis gas. The synthesis gas can then be converted (517) to stable gases or energy can be recovered from the synthesis gas. Finally, the synthesis gas is filtered (518) prior to release to the ambient environment.

With regard to the molten reaction products, such molten products are removed (510) from the process chambers for recycling or disposal. In this regard, recyclable metallic materials may be recovered from either reactor chamber by adjusting the chemistry of the reaction so that the molten metal and slag is phase separated. Subsequently, the recyclable metal is poured (511) into an ingot and cooled (512) for recovery and reuse. The slag is separately poured (513) into a glass container and cooled (514) to stabilize the slag for storage or disposal. If the waste treatment run is not complete (519), additional waste can be introduced into the first chamber and the process continues. Once the supply of waste feed is exhausted, the process chamber heating systems are deactivated (520) and the process is complete.

While various embodiments and applications of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for processing waste, comprising the steps of:

heating an organic destruction chamber to a temperature within a temperature range between about 250° F. and about 2200° F. during an organic destruction operation;

heating a refractory lined vitrification chamber having a reactor bed to a temperature within a temperature range between about 2000° F. and about 2500° F. during the organic destruction operation, the vitrification chamber being connected to the organic destruction chamber by a duct;

introducing waste into the organic destruction chamber;

reacting at least a portion of the waste in the organic destruction chamber to yield a first reaction product that remains in the organic destruction chamber during the organic destruction operation and a first effluent that leaves the organic destruction chamber via the duct;

introducing the first effluent into the vitrification chamber through the duct;

reacting at least a portion of the first effluent in the vitrification chamber to yield a second reaction product in the reactor bed and a second effluent outside of the reactor bed;

introducing the second effluent into a gaseous effluent processing system; and reducing the temperature of the organic destruction chamber prior to removing the first reaction product.

2. The method of claim 1, wherein the waste comprises metal.

3. The method of claim 1, wherein the waste comprises hazardous organic waste.

4. The method of claim 2, wherein the first reaction product comprises metal.

5. The method of claim 4, wherein the first reaction product comprises ash.

6. The method of claim 1, wherein introducing the waste into the organic destruction chamber further comprises:

introducing the waste into a loading chamber connected to the organic destruction chamber;

sealing the loading chamber from an external environment;

conveying the waste from the loading chamber into the organic destruction chamber; and sealing the organic destruction chamber from the loading chamber.

7. The method of claim 6, wherein the waste is loaded onto a transport cart within the loading chamber, the transport cart is conveyed to the organic destruction chamber, and the transport cart remains within the organic destruction chamber during destruction of the waste.

8. The method of claim 7, wherein the waste is transported in one or more thermally resistant containers on the transport cart, the containers remain in the organic destruction chamber during destruction of the waste, and the containers remain intact during destruction of the waste.

9. The method of claim 7, wherein the waste is transported in one or more thermally destroyable containers on the transport cart, the containers remain in the organic destruction chamber during destruction of the waste, and the containers are destroyed during destruction of the waste.

10. The method of claim 1, wherein heating the organic destruction reactor chamber further comprises:

employing a flameless infrared heater.

11. The method of claim 10, wherein heating the refractory lined vitrification chamber further comprises:

employing a joule effect heater.

12. The method of claim 1 further comprising:

heating a refractory lined preliminary vitrification chamber having a preliminary reactor bed to a temperature within a temperature range between about 2000° F. and about 2500° F., the preliminary vitrification chamber being connected to the vitrification chamber; and directing a third effluent from the preliminary vitrification chamber into the vitrification chamber.

13. The method of claim 1, wherein the organic destruction chamber is heated to a temperature within a temperature range between about 300° F. and about 1800° F. during the organic destruction operation.

14. A waste reactor for treating waste, comprising:

a waste loading area having a first sealable opening through which waste is received;

a refractory-lined organic destruction chamber having a second sealable opening to receive the waste from the waste loading area;

a heat-resistant waste conveying mechanism that conveys waste from the waste loading area through the second sealable opening into the organic destruction chamber;

a flameless infrared heater to heat the organic destruction chamber to a temperature within a temperature range between about 250° F. and about 2100° F. during an organic destruction operation wherein the waste is reacted to yield a first reaction product that remains in the organic destruction chamber during destructive processing of the waste and a first effluent;

a refractory-lined vitrification chamber having a reactor bed and being connected to the organic destruction chamber so as to receive the first effluent;

a joule effect heater to heat the vitrification chamber to a temperature within a temperature range between about 2000° F. and about 2500° F. during the organic destruction operation wherein the vitrification chamber receives the first effluent and reacts it to yield a second reaction product in the reactor bed and a second effluent that exits the vitrification chamber; and an effluent processing system connected to the vitrification chamber to receive the second effluent and convert at least a portion of the second effluent into a stable gaseous compound that can be safely discharged to the atmosphere.

15. The waste reactor of claim 14, wherein the waste comprises metal.

16. The waste reactor of claim 14, wherein the waste comprises hazardous organic waste.

17. The waste reactor of claim 15, wherein the first reaction product comprises metal.

18. The waste reactor of claim 16, wherein the first reaction product comprises ash.

19. The waste reactor of claim 14, wherein the organic destruction chamber is heated to a temperature within a temperature range between about 300° F. and about 1800° F. during the organic destruction operation.

20. The waste reactor of claim 14, wherein the heat-resistant waste conveying mechanism comprises a transport cart that is adapted to transport one or more containers of waste from the waste loading area into the organic destruction chamber and remain in the organic destruction chamber during the organic destruction operation.

21. The waste reactor of claim 20, wherein the containers are thermally resistant, adapted to remain in the organic destruction chamber during destruction of the waste, and remain intact during destruction of the waste.

22. The waste reactor of claim 14 further comprising:

a refractory lined preliminary vitrification chamber having a preliminary reactor bed and being connected to the vitrification chamber such that a third effluent from the preliminary vitrification chamber flows into the vitrification chamber which converts at least a portion of the third effluent into the second effluent; and a heater for heating the preliminary vitrification chamber to a temperature within a temperature range between about 2000° F. and about 2500° F. wherein the third effluent is produced.

* * * * *